US011629562B1

(12) United States Patent
Samuel et al.

(10) Patent No.: US 11,629,562 B1
(45) Date of Patent: Apr. 18, 2023

(54) DETERMINING CHARACTERISTICS OF FLUID LOSS IN A WELLBORE

(71) Applicant: Landmark Graphics Corporation, Houston, TX (US)

(72) Inventors: Robello Samuel, Cypress, TX (US); Rishi Adari, Katy, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 17/497,155

(22) Filed: Oct. 8, 2021

(51) Int. Cl.

| | |
|---|---|
| ***E21B 21/08*** | (2006.01) |
| ***E21B 21/00*** | (2006.01) |
| ***E21B 47/117*** | (2012.01) |
| ***E21B 43/26*** | (2006.01) |

(52) U.S. Cl.
CPC ..... *E21B 21/003* (2013.01); *E21B 43/26* (2013.01); *E21B 47/117* (2020.05); *E21B 2200/20* (2020.05)

(58) Field of Classification Search
CPC ..... E21B 21/003; E21B 21/08; E21B 2200/20
See application file for complete search history.

(56) References Cited

U.S. PATENT DOCUMENTS

| | | | | |
|---|---|---|---|---|
| 2,966,059 | A | 12/1960 | Dower | |
| 2,985,731 | A | 5/1961 | Taylor | |
| 9,784,100 | B2 * | 10/2017 | Haberer | E21B 47/10 |
| 10,683,744 | B2 * | 6/2020 | Torrione | E21B 47/003 |
| 11,125,046 | B2 * | 9/2021 | Li | E21B 21/003 |
| 11,360,235 | B2 * | 6/2022 | Lu | G01V 99/005 |
| 2013/0299241 | A1 | 11/2013 | Alberty et al. | |
| 2017/0335664 | A1 * | 11/2017 | Dykstra | E21B 43/267 |
| 2020/0191994 | A1 | 6/2020 | Lu et al. | |
| 2022/0136344 | A1 * | 5/2022 | Mora | H04N 7/183 175/48 |

FOREIGN PATENT DOCUMENTS

| | | | |
|---|---|---|---|
| CN | 112529341 | A1 | 3/2021 |
| WO | 2017074456 | A1 | 5/2017 |

OTHER PUBLICATIONS

Mansure et al., A probabilistic Reasoning Tool for Circulation Monitoring Based on Flow Measurements, SPE Annual Technical Conference and Exhibition, Oct. 1999.
International Application, International Search Report and Written Opinion, PCT/US2021/057085, dated Jun. 30, 2022, 9 pages.

* cited by examiner

*Primary Examiner* — Kenneth L Thompson
(74) *Attorney, Agent, or Firm* — Kilpatrick Townsend & Stockton LLP

(57) ABSTRACT

A system can provide for determining characteristics loss in a wellbore. The system can include a processor and a non-transitory memory with instructions that are executable by the processor for causing the processor to execute operations. The operations can include receiving, from sensors in a wellbore, data corresponding to loss indicators. The operations can include determining a loss probability for each loss indicator. The operations can include determining a total loss probability of fluid loss in the wellbore based on the loss probabilities. The operations can include outputting the total loss probability to be used in a drilling operation in the wellbore.

20 Claims, 5 Drawing Sheets

DETERMINING CHARACTERISTICS OF FLUID LOSS IN A WELLBORE

TECHNICAL FIELD

The present disclosure relates generally to wellbore drilling operations and, more particularly (although not necessarily exclusively), to determining characteristics of fluid loss in a wellbore during to drilling operations.

BACKGROUND

A drilling operation may involve forming a wellbore in a subterranean formation to extract hydrocarbons. One challenge in drilling operations is loss circulation. Loss circulation can involve the uncontrolled flow of drilling fluid leaking into the formation during drilling or cementing processes. Loss circulation can contribute to drilling non-productive time. Loss circulation may occur when well pressures exceed the subterranean formation pore pressures, causing the drilling fluid to leak into the formation such that the drilling operation is stopped to mitigate the issue

DETAILED DESCRIPTION

Figure 1:
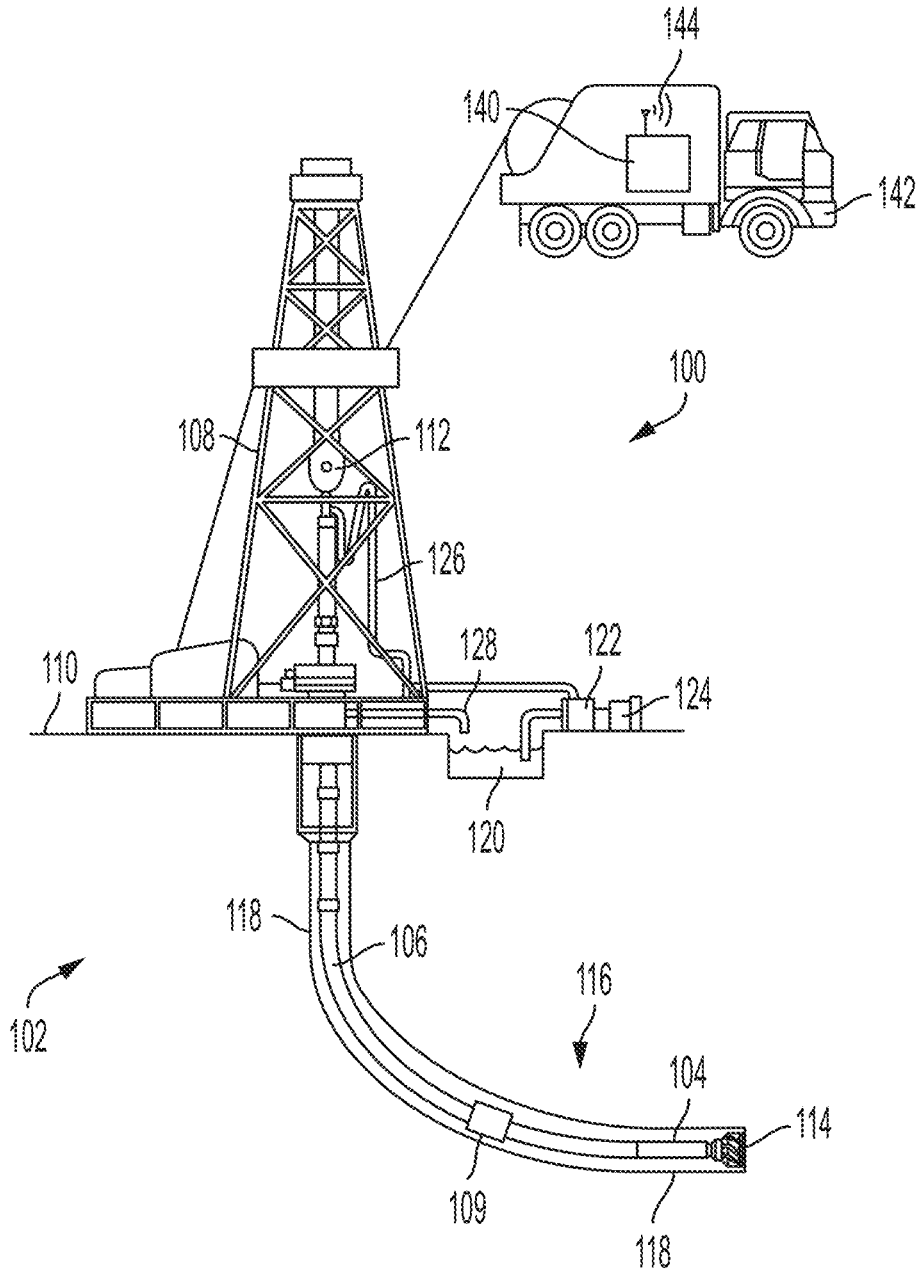
FIG. 1 is a schematic of a wellbore drilling system for determining loss according to one example of the present disclosure.

Certain aspects and examples of the present disclosure relate to determining the severity and origin of drilling fluid loss in a wellbore. In some examples, drilling fluid that is circulated in the wellbore during drilling operations may leak out of the wellbore into the surrounding subterranean formation. Various types of formations may cause loss circulation. In general, three types of formations are responsible for loss circulation: natural or induced fractures, highly permeable formations, and vugular formations. It may be difficult to determine the source and the severity of loss in real-time as the drilling fluid is leaking into the formation. Sensor data from the wellbore may be used to determine characteristics of the loss, which in turn may be used to determine loss mitigation operations in the wellbore.

Loss circulation can be classified in various ways. In some examples, loss circulation can be classified by the severity of the amount of drilling fluid lost. For example, a moderate amount of loss may be less than 10 bbl/hr, and a severe or total amount of loss may be between 10 bbl/hr and 30 bbl/hr. In other examples, loss circulation can be categorized by the loss origin, which is the type of formation that causes a leakage channel, such as natural or induced fractures. Natural fractures may be existing fractures in the formation that can cause fluid leakage. Induced fractures may be fractures created by drilling operations. For example, when the fluid column pressure in the wellbore is greater than the pressure in the formation pressure, fractures through which fluid may flow can be created. Cavernous or vugular formations may also cause loss of fluid. Additionally, some types of formations such as sandstone may be highly permeable and thus more susceptible to fluid loss. Sensors in the wellbore or in fluid tanks may measure data related to the fluid loss.

For example, real-time sensor data collected during fluid loss may be transmitted to a computing device. The computing device may input the real-time sensor data along with a model of the wellbore and the current drilling operation to an AI model. The computing device may use the AI model and a trend analysis model to determine the loss origin by calculating probabilities of different loss types. The calculations may be updated continuously as more sensor data is received from the wellbore. The computing device may determine a loss mitigation operation depending on the determined loss type.

In some examples, the sensor data may correspond to various downhole loss indicators. The computing device may input the sensor data into the trend analysis model to determine loss indicators. The loss indicators may include a flow gain indicator, a tank volume gain indicator, and a formation pressure indicator. Flow gain may be the rate at which the output flow of the drilling fluid changes with respect to the input flow of the drilling fluid, and may be measured by sensors positioned in the flow path in the wellbore. Sensors in the tank used for pumping the drilling fluid may be used to determine changes in tank volume over time. Additionally, sensors in the wellbore may be used to determine changes in the formation pressure over time. In some examples, the formation pressure indicator may be determined by inputting characteristics such as the sensor data, rate of penetration of the drill bit, revolution rate of the drill bit, weight on the drill bit, and the size of the drill bit into the trend analysis model. In some examples, the flow gain indicator and tank volume indicator may be primary loss indicators, and the formation pressure indicator may be a secondary loss indicator. In some examples, more or fewer loss indicators may be used to determine loss type.

The computing device may use the trend analysis model to analyze the changes in the sensor data over time. For example, inflection points in the changes in sensor data over time may indicate loss caused by certain types of formations. The trend analysis model may determine changes over time using, for example, the divergence of moving average or the divergence of moving slope average. The computing device may use the loss indicators to determine loss probabilities for each loss indicator. The computing device may weight each loss probability according to its loss indicator type to determine a total loss probability. In some examples, the weights may be initially assigned equal or random values. The computing device may execute the AI model to continuously adjust the weights based on the incoming real-time sensor data from the wellbore.

The total loss probability may be a probabilistic estimation of the amount of loss in the wellbore. The computing device may compare the total loss probability to an expected loss in the wellbore, which may be determined via the AI model using the model of the wellbore and the sensor data. In some examples, the computing device may determine the loss origin using the total loss probability and the difference between the total loss probability and the expected loss. The loss origin may also be determined from the trend analysis of the flow indicators. In some examples, the computing device may determine drilling operations to be performed in response to the loss, such as loss mitigation operations. In some examples, the computing device may be included in an automated system, such as an automated rig. The computing device may monitor the loss over time and may output predetermined loss benchmarks to a controller for determining loss mitigation operations.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a wellbore drilling system 100 for determining loss according to one example of the present disclosure. A wellbore 118 used to extract hydrocarbons may be created by drilling into a subterranean formation 102 using the wellbore drilling system 100. The wellbore drilling system 100 may include a bottom hole assembly (BHA) 104 positioned or otherwise arranged at the bottom of a drill string 106 extended into the subterranean formation 102 from a derrick 108 arranged at the surface 110. The derrick 108 includes a kelly 112 used to lower and raise the drill string 106, which may be moved axially within the wellbore 118 as attached to the drill string 106. The tool string 116 may include one or more sensors 109. The sensors 109 may be positioned on drilling equipment and may sense wellbore conditions, such as flow loss in the wellbore 118. The sensors 109 can send signals to the surface 110 via a wired or wireless connection, and the sensors 109 may send real-time data relating to the drilling operation to the surface 110. The combination of any support structure (in this example, derrick 108), any motors, electrical equipment, and support for the drill string 106 and tool string 116 may be referred to herein as a drilling arrangement.

During operation, the drill bit 114 penetrates the subterranean formation 102 and thereby can create the wellbore 118. The BHA 104 provides control of the drill bit 114 as it advances into the subterranean formation 102. The combination of a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles (not shown) and arranged in the drill bit 114 and in the process cools the drill bit 114. After exiting the drill bit 114, the mud circulates back to the surface 110 via the annulus defined between the wellbore 118 and the drill string 106, and hole cleaning can occur which involves returning the drill cuttings and debris to the surface. The cuttings and mud mixture are passed through a flow line 128 and are processed such that a cleaned mud is returned down hole through the stand pipe 126 once again. In some examples where the wellbore pressure exceeds the pressure of the subterranean formation 102 pore pressure, the mud may leak out of the wellbore 118 into the subterranean formation 102. Sensors 109 may be positioned in the mud tank 120 to sense a decrease in mud volume.

The drilling arrangement and any sensors 109 (through the drilling arrangement or directly) can be connected to a computing device 140. In FIG. 1, the computing device 140 is illustrated as being deployed in a work vehicle 142; however, a computing device to receive data from sensors 109 and to control drill bit 114 can be permanently installed with the drilling arrangement, be hand-held, or be remotely located. Although one computing device 140 is depicted in FIG. 1, in other examples, more than one computing device can be used, and together, the multiple computing devices can perform operations, such as those described in the present disclosure.

The computing device 140 can include a processor interfaced with other hardware via a bus. A memory, which can include any suitable tangible (and non-transitory) computer-readable medium, such as random-access memory ("RAM"), read-only memory ("ROM"), electrically erasable and programmable read-only memory ("EEPROM"), or the like, can embody program components that configure the operation of the computing device 140. In some aspects, the computing device 140 can include input/output interface components (e.g., a display, printer, keyboard, touch-sensitive surface, and mouse) and additional storage.

The computing device 140 can include a communication device 144. The communication device 144 can represent one or more of any components that facilitate a network connection. In the example shown in FIG. 1, the communication devices 144 are wireless and can include wireless interfaces such as IEEE 802.11, Bluetooth, or radio interfaces for accessing cellular telephone networks (e.g., transceiver/antenna for accessing a CDMA, GSM, UMTS, or other mobile communication network). In some examples, the communication device 144 can use acoustic waves, surface waves, vibrations, optical waves, or induction (e.g., magnetic induction) for engaging in wireless communications. In other examples, the communication device 144 can be wired and can include interfaces such as Ethernet, USB, IEEE 1394, or a fiber optic interface. In an example with at least one other computing device, the computing device 140 can receive wired or wireless communications from the other computing device and perform one or more tasks based on the communications. For example, the computing device 140 can be used to determine probabilities of various loss indicators, probability of the amount of loss, characteristics of the loss, loss mitigation operations, etc.

Figure 2:
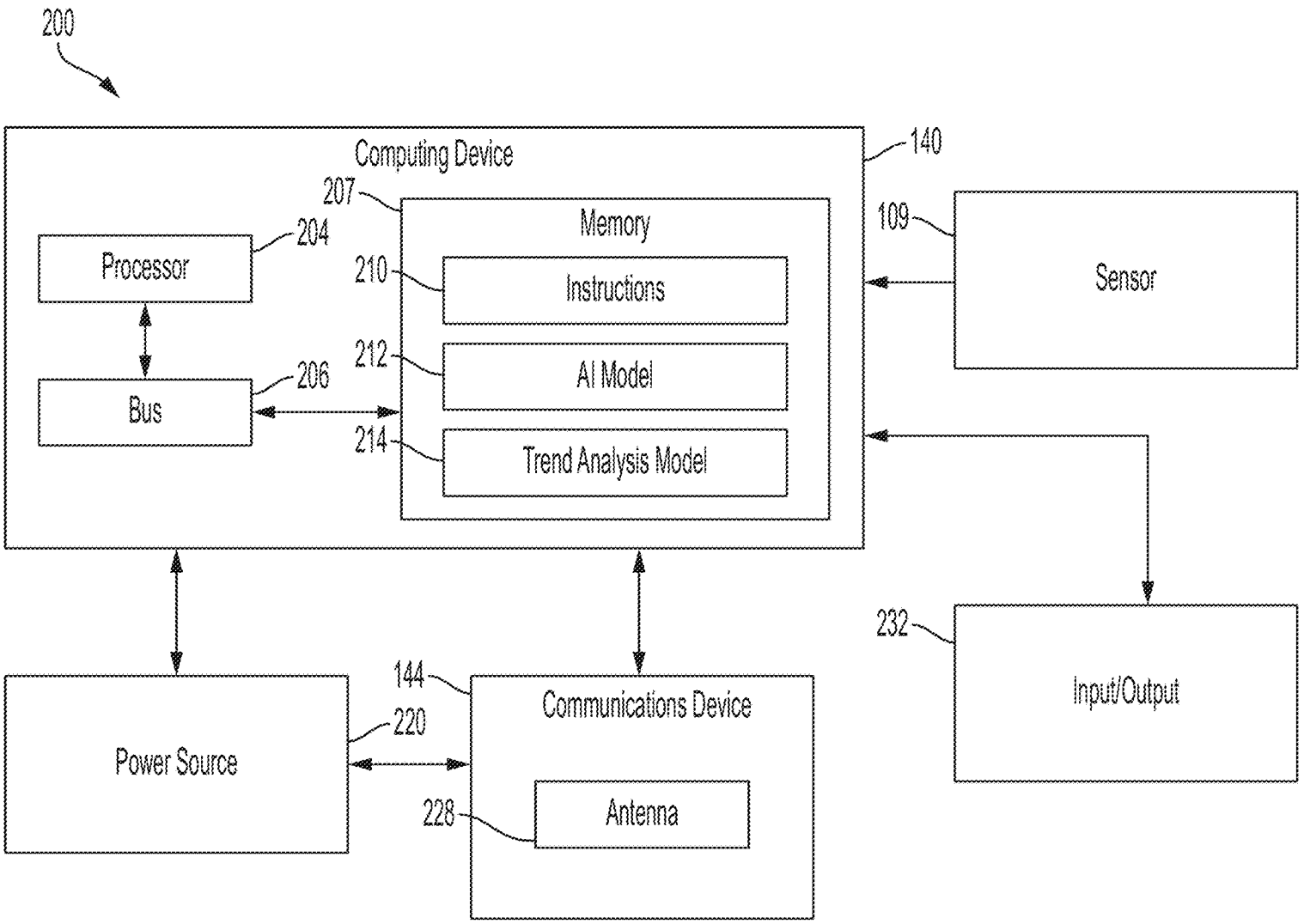
FIG. 2 is a block diagram of a computing system for determining loss in a wellbore according to one example of the present disclosure.

FIG. 2 is a block diagram of a computing system 200 for determining loss in a wellbore according to one example of the present disclosure. The computing system 200 includes the computing device 140. The computing device 140 can include a processor 204, a memory 207, and a bus 206. The computing device 140 can execute instructions 210 for determining characteristics of fluid loss in a wellbore 118 during a drilling operation. The processor 204 can execute instructions stored in the memory 207 to perform operations. The processor 204 can include one processing device or multiple processing devices or cores. Non-limiting examples of the processor include a Field Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 include EEPROM, flash memory, or any other type of non-volatile memory. In some examples, at least part of the memory 207 can include a medium from which the processor 204 can read instructions 210. A computer-readable medium can include electronic, optical, magnetic, or other storage devices capable of providing the processor 204 with computer-readable instructions or other program code. Non-limiting examples of a computer-readable medium include (but are not limited to) magnetic disk(s), memory chip(s), ROM, RAM, an ASIC, a configured processor, optical storage, or any other medium from which a computer processor can read instructions 210. The instructions 210 can include processor-specific instructions generated by a compiler or an interpreter from code written in any suitable computer-programming language, including, for example, C, C++, C#, etc.

In some examples, the memory can include an AI model 212 and a trend analysis model 214. The AI model 212 can include a model of the wellbore 118. The processor 204 may use the AI model 212 and the trend analysis model 214 to determine the total loss probability for the wellbore 118, the loss origin, and loss mitigation operations. The computing system 200 may output the loss mitigation operations to be implemented downhole.

The computing system 200 can include a power source 220. The power source 220 can be in electrical communication with the computing device 140 and the communications device 144. In some examples, the power source 220 can include a battery or an electrical cable (e.g., a wireline). In some examples, the power source 220 can include an AC signal generator. The computing device 140 can operate the power source 220 to apply a transmission signal to the antenna 228 to forward data relating to drilling parameters, connections, etc. to other systems. For example, the computing device 140 can cause the power source 220 to apply a voltage with a frequency within a specific frequency range to the antenna 228. This can cause the antenna 228 to generate a wireless transmission. In other examples, the computing device 140, rather than the power source 220, can apply the transmission signal to the antenna 228 for generating the wireless transmission.

In some examples, parts of the communications device 144 can be implemented in software. For example, the communications device 144 can include additional instructions stored in memory 207 for controlling functions of the communication device 144. The communications device 144 can receive signals from remote devices and transmit data to remote devices. For example, the communications device 144 can transmit wireless communications that are modulated by data via the antenna 228.

The computing system 200 can receive input, such as the real-time data, from sensor(s) 109. The computing system 200 in this example also includes input/output interface 232. Input/output interface 232 can connect to a keyboard, pointing device, display, and other computer input/output devices. An operator may provide input using the input/output interface 232. Trend analysis of loss indicators can be included in a display that is outputted via the input/output interface 232.

In some examples, the components shown in FIG. 2, e.g., the computing device 140, power source 220, and communications device 144, can be integrated into a single structure. For example, the components can be within a single housing. In other examples, the components shown in FIG. 2 can be distributed, such as in separate housings, and in electrical communication with each other.

Figure 3:
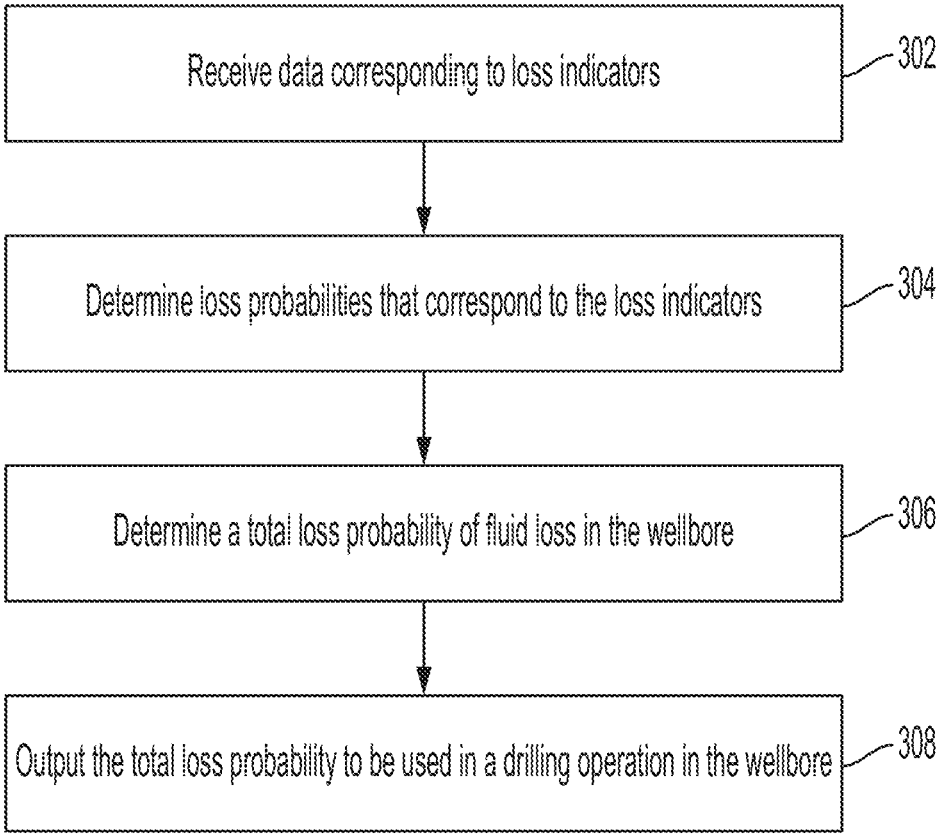
FIG. 3 is a flow chart of a process for determining loss in a wellbore according to one example of the present disclosure.

FIG. 3 is a flow chart of a process for determining loss in a wellbore according to one example of the present disclosure. A processor, such as the processor 204 in FIG. 2, can perform the operations of the flow chart. Other examples can include more operations, fewer operations, different operations, or a different order of operations shown in FIG. 3.

At block 302, the processor 204 receives data corresponding to loss indicators from sensors 109 in a wellbore 118. For example, sensors 109 in the flow path of the wellbore may measure flow rate for the flow gain indicator, and sensors 109 in the mud tank 120 may measure mud volume for the tank volume indicator. The processor 204 may determine the loss indicators using the trend analysis model 214 and the sensor data. The trend analysis model 214 may track changes in the sensor data for the loss indicators over time.

At block 304, the processor 204 determines a loss probability for each loss indicator. For example, the processor 204 may calculate a loss probability using the following equation, where LI represents loss probability, $I_{pred}$ represents predicted loss from the trend analysis model, $I_{actual}$ represents actual loss from the sensor data, and $I_{tolerance}$ represents a tolerance for the loss indicator:

$$LI = \frac{\int (I_{pred} - I_{actual})dt}{I_{tolerance}}$$

At block 306, the processor 204 determines a total loss probability of fluid loss in the wellbore 118 based on the individual loss probabilities. For example, the processor 204 may calculate a total loss probability suing the following equation, where TLP represents total loss probability, $\omega_n$ represents a weight for an individual loss probability, $LI_{FG}$ represents a loss probability for the flow gain indicator, $LI_{VG}$ represents a loss probability for the tank volume indicator, $LI_{FP}$ represents a loss probability for the formation pressure indicator, and $LI_{nP}$ represents a loss probability for any other loss indicators:

$$TLP=\omega_1*LI_{FE}+\omega_2*LI_{VG}+\omega_3*LI_{FP}+\omega_n*LI_{nP}$$

In some examples, the processor 204 may initially assign each weight $\omega_n$ an equal value, such as ½. Alternatively, the processor 204 may initially assign each weight value $\omega_n$ a random value. The processor 204 may continuously adjust the weights $\omega_n$ using the AI model 212 as additional sensor data is received from the wellbore 118. The total loss probability may be a predicted total amount of loss in the wellbore 118.

At block 308, the processor 204 outputs the total loss probability to be used in a drilling operation in the wellbore 118. The processor 204 may determine a drilling operation based on the loss origin to be output for implementation. For example, the drilling operation may be a loss mitigation operation such as preventing flow of mud from the mud tank 120.

Figure 4:
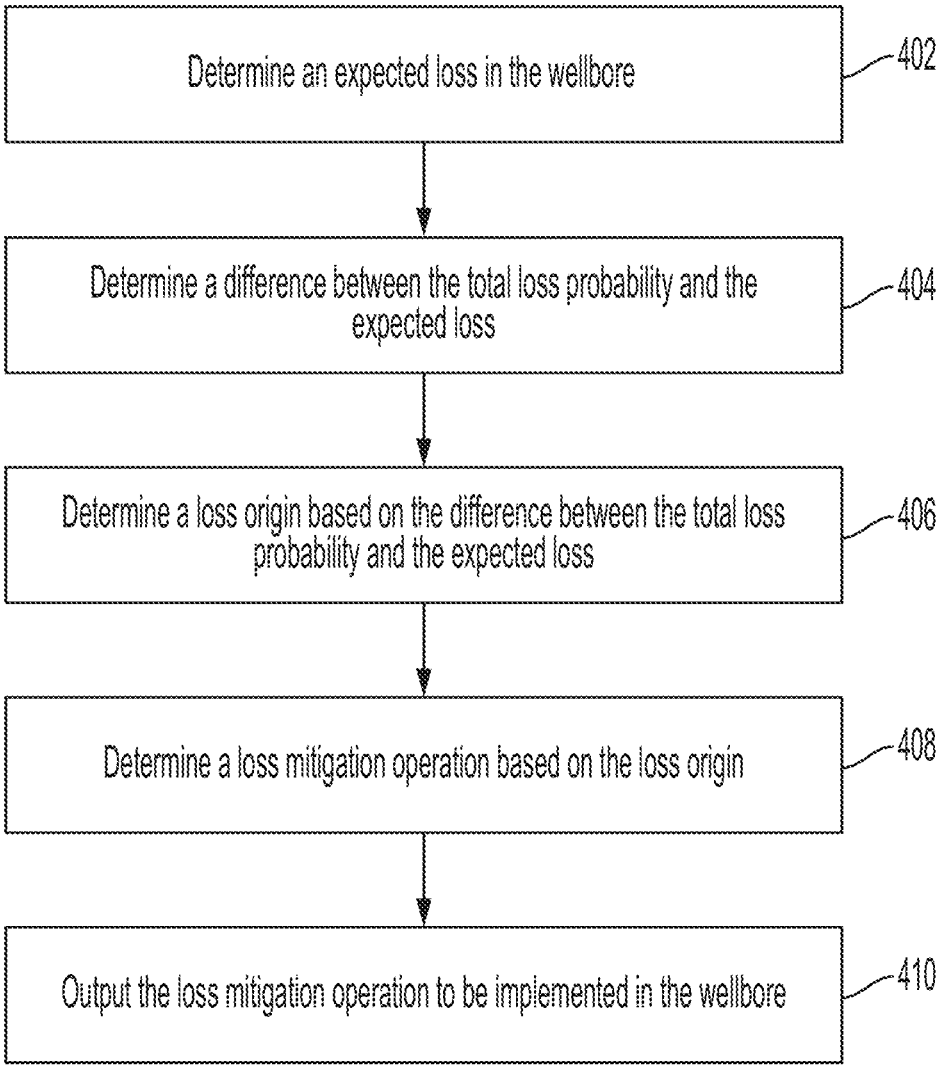
FIG. 4 is a flow chart of a process for determining a loss mitigation operation in a wellbore according to one example of the present disclosure

FIG. 4 is a flow chart of a process for determining a loss mitigation operation in a wellbore according to one example of the present disclosure. A processor, such as the processor 204 in FIG. 2, can perform the operations of the flow chart. Other examples can include more operations, fewer operations, different operations, or a different order of operations shown in FIG. 4.

At block 402, the processor 204 determines an expected loss in the wellbore 118. In some examples, the processor 204 may execute the AI model 212 to determine the expected loss. The AI model 212 may use a model of the wellbore 118, inputs regarding the current drilling operation, and a hydraulics model to determine the expected loss in the wellbore 118. At block 404, the processor 204 determines a difference between the total loss probability determined in FIG. 3 and the expected loss.

At block 406, the processor 204 determines a loss origin based on the difference between the total loss probability and the expected loss. For example, the loss origin may be a matrix loss, a natural fracture loss, an induced fracture loss, or a cavernous fracture loss. In some examples, the processor 204 may also determine the loss origin from trend analysis of the flow indicators. For example, FIG. 5 depicts graphs showing trend analysis for the tank volume gain indicator over time based on the type of loss origin.

Figure 5:
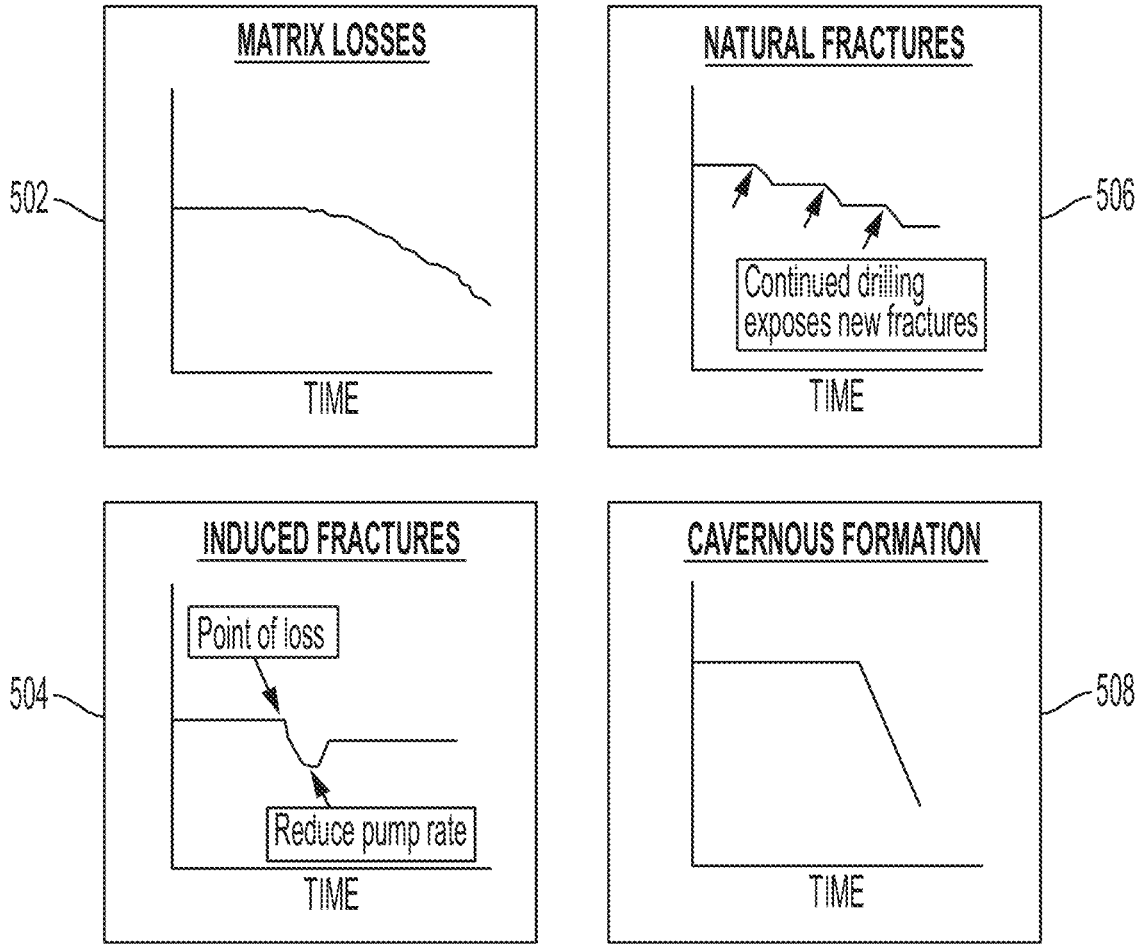
FIG. 5 is a series of graphs showing a change in tank volume over time for various loss origins, according to one example of the present disclosure.

FIG. 5 is a series of graphs showing a change in tank volume over time for various loss origins, according to one example of the present disclosure. Graph 502 depicts an example of a change in volume over time for matrix losses. The gradual decline of volume may indicate that the drilling fluid is slowly leaking into the matrix. Graph 504 depicts an example of a change in tank volume over time for induced fractures. The sudden decline, reduced pump rate, and then stable (yet lower) volume may indicate that the drilling operation created a fracture into which drilling fluid leaked. Graph 506 depicts an example of a change in volume over time for natural fractures. The multiple sudden decreases in volume may indicate that drilling is continuously exposing new fractures present in the formation. Graph 508 depicts an example of a change in volume over time for cavernous formations. The sudden, drastic decrease in volume may indicate that the drilling operation has exposed a large and cavernous formation into which a large amount of drilling fluid flows.

Referring back to FIG. 4, at block 408, the processor 204 determines a loss mitigation operation based on the loss origin. For example, the processor 204 may determine a loss mitigation operation involving sealing a natural or induced fracture. At block 410, the processor 204 outputs the loss mitigation operation to be implemented in the wellbore 118.

In some aspects, system, method, and non-transitory computer-readable medium for determining origins of fluid loss in a wellbore are provided according to one or more of the following examples:

Example #1: A system can include a processor and a non-transitory computer-readable memory comprising instructions that are executable by the processor for causing the processor to execute operations. The operations can include: receiving, from sensors in a wellbore, data corresponding to a plurality of loss indicators; determining a plurality of loss probabilities, each loss probability of the plurality of loss probabilities corresponding to a loss indicator of the plurality of loss indicators; determining, based on the plurality of loss probabilities, a total loss probability of fluid loss in the wellbore; and outputting the total loss probability to be used in a drilling operation in the wellbore.

Example #2: The system of Example #1 may feature the memory further comprising instructions that are executable by the processor to: determine, using a model of the wellbore, an expected loss in the wellbore; determine a difference between the total loss probability and the expected loss; determine, based on the difference between the total loss and the expected loss, a loss origin; determine, based on the loss origin, a loss mitigation operation; and output the loss mitigation operation to be implemented in the wellbore.

Example #3: The system of any of Examples #1-2 may feature the loss origin comprising a matrix loss, a natural fracture loss, an induced fracture loss, and a cavernous formation loss.

Example #4: The system of any of Examples #1-3 may feature the memory further comprising instructions that are executable by the processor for causing the processor to: determine the total loss probability by: determining a plurality of weights, each weight of the plurality of weights corresponding to a loss probability of the plurality of loss probabilities; and weighting, by the plurality of weights, the plurality of loss probabilities to determine the total loss probability.

Example #5: The system of any of Examples #1-4 may feature the memory further comprising instructions that are executable by the processor for causing the processor to continuously adjust the plurality of weights based on newly received data corresponding to the plurality of loss indicators.

Example #6: The system of any of Examples #1-5 may feature the plurality of loss indicators comprising a flow gain indicator, a tank volume indicator, and a formation pressure indicator.

Example #7: The system of any of Examples #1-6 may feature receiving the data corresponding to the plurality of loss indicators during a drilling operation.

Example #8: A method may include receiving, from sensors in a wellbore, data corresponding to a plurality of loss indicators; determining, by a computing device, a plurality of loss probabilities, each loss probability of the plurality of loss probabilities corresponding to a loss indicator of the plurality of loss indicators; determining, by the computing device and based on the plurality of loss probabilities, a total loss probability of fluid loss in the wellbore; and outputting, by the computing device, the total loss probability to be used in a drilling operation in the wellbore.

Example #9: The method of Example #8 can include determining, using a model of the wellbore, an expected loss in the wellbore; determining a difference between the total loss probability and the expected loss; determining, based on the difference between the total loss and the expected loss, a loss origin; determining, based on the loss origin, a loss mitigation operation; and outputting the loss mitigation operation to be implemented in the wellbore.

Example #10: The method of any of Examples #8-9 may feature the loss origin comprising a matrix loss, a natural fracture loss, and a cavernous formation loss.

Example #11: The methods of any of Examples #8-10 may feature determining the total loss probability by: determining a plurality of weights, each weight of the plurality of weights corresponding to a loss probability of the plurality of loss probabilities; and weighting, by the plurality of weights, the plurality of loss probabilities to determine the total loss probability.

Example #12: The methods of any of Examples #8-11 may include adjusting, based on newly received data corresponding to the plurality of loss indicators, the plurality of weights continuously.

Example #13: The methods of any of Examples #8-12 may feature the plurality of loss indicators comprising a flow gain indicator, a tank volume indicator, and a formation pressure indicator.

Example #14: The methods of any of Examples #8-13 may include the computing device receiving the data corresponding to the plurality of loss indicators during a drilling operation.

Example #15: A non-transitory computer-readable medium may comprise instructions that are executable by a processor for causing the processor to perform operations. The operations can include receiving, from sensors in a wellbore, data corresponding to a plurality of loss indicators; determining a plurality of loss probabilities, each loss probability of the plurality of loss probabilities corresponding to a loss indicator of the plurality of loss indicators; determining, based on the plurality of loss probabilities, a total loss probability of fluid loss in the wellbore; and outputting the total loss probability to be used in a drilling operation in the wellbore.

Example #16: The non-transitory computer-readable medium of Example #15 can include instructions that are executable by the processor for causing the processor to: determine, using a model of the wellbore, an expected loss in the wellbore; determine a difference between the total loss probability and the expected loss; determine, based on the difference between the total loss and the expected loss, a loss origin; determine, based on the loss origin, a loss mitigation operation; and output the loss mitigation operation to be implemented in the wellbore.

Example #17: The non-transitory computer-readable medium of any of Examples #15-16 may feature the loss origin comprising a matrix loss, a natural fracture loss, an induced fracture loss, and a cavernous formation loss.

Example #18: The non-transitory computer-readable medium of any of Examples #15-17 may feature instructions that are executable by the processor for causing the processor to determine the total loss probability by: determining a plurality of weights, each weight of the plurality of weights corresponding to a loss probability of the plurality of loss probabilities; and weighting, by the plurality of weights, the plurality of loss probabilities to determine the total loss probability.

Example #19: The non-transitory computer-readable medium of any of Examples #15-18 may feature instructions that are executable by the processor for causing the processor to continuously adjust the plurality of weights based on newly received data corresponding to the plurality of loss indicators.

Example #20: The non-transitory computer-readable medium of any of Examples #15-19 may feature the plurality of loss indicators comprising a flow gain indicator, a tank volume indicator, and a formation pressure indicator.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processor; and a non-transitory computer-readable memory comprising instructions that are executable by the processor for causing the processor to:

receive, from sensors in a wellbore, data corresponding to a plurality of loss indicators;

determine a plurality of loss probabilities, each loss probability of the plurality of loss probabilities corresponding to a loss indicator of the plurality of loss indicators;

determine, based on the plurality of loss probabilities, a total loss probability of fluid loss in the wellbore;

determine, based on the total loss probability of fluid loss in the wellbore, a loss mitigation operation; and control the loss mitigation operation in the wellbore.

2. The system of claim 1, wherein the memory further comprises instructions that are executable by the processor to:

determine, using an artificial intelligence model of the wellbore, an expected loss in the wellbore;

determine a difference between the total loss probability and the expected loss;

determine, based on the difference between the total loss and the expected loss, a loss origin;

determine, based on the loss origin, the loss mitigation operation; and output the loss mitigation operation to be implemented in the wellbore.

3. The system of claim 2, wherein the loss origin comprises a matrix loss, a natural fracture loss, an induced fracture loss, and a cavernous formation loss.

4. The system of claim 1, wherein the memory further comprises instructions that are executable by the processor for causing the processor to determine the total loss probability by:

determining a plurality of weights, each weight of the plurality of weights corresponding to a loss probability of the plurality of loss probabilities; and weighting, by the plurality of weights, the plurality of loss probabilities to determine the total loss probability.

5. The system of claim 4, wherein the memory further comprises instructions that are executable by the processor for causing the processor to continuously adjust the plurality of weights based on newly received data corresponding to the plurality of loss indicators.

6. The system of claim 1, wherein the plurality of loss indicators comprises a flow gain indicator, a tank volume indicator, and a formation pressure indicator.

7. The system of claim 1, wherein the system receives the data corresponding to the plurality of loss indicators during a drilling operation.

8. A method comprising:

receiving, from sensors in a wellbore, data corresponding to a plurality of loss indicators;

determining, by a computing device, a plurality of loss probabilities, each loss probability of the plurality of loss probabilities corresponding to a loss indicator of the plurality of loss indicators;

determining, by the computing device and based on the plurality of loss probabilities, a total loss probability of fluid loss in the wellbore;

determining, by the computing device and based on the total loss probability of fluid loss in the wellbore, a loss mitigation operation; and controlling, by the computing device, a loss mitigation operation in the wellbore.

9. The method of claim 8, further comprising:

determining, using an artificial intelligence model of the wellbore, an expected loss in the wellbore;

determining a difference between the total loss probability and the expected loss;

determining, based on the difference between the total loss and the expected loss, a loss origin;

determining, based on the loss origin, the loss mitigation operation; and outputting the loss mitigation operation to be implemented in the wellbore.

10. The method of claim 9, wherein the loss origin comprises a matrix loss, a natural fracture loss, an induced fracture loss, and a cavernous formation loss.

11. The method of claim 8, wherein determining the total loss probability further comprises:

determining a plurality of weights, each weight of the plurality of weights corresponding to a loss probability of the plurality of loss probabilities; and weighting, by the plurality of weights, the plurality of loss probabilities to determine the total loss probability.

12. The method of claim 11, further comprising:

adjusting, based on newly received data corresponding to the plurality of loss indicators, the plurality of weights continuously.

13. The method of claim 8, wherein the plurality of loss indicators comprises a flow gain indicator, a tank volume indicator, and a formation pressure indicator.

14. The method of claim 8, wherein the computing device receives the data corresponding to the plurality of loss indicators during a drilling operation.

15. A non-transitory computer-readable medium comprising instructions that are executable by a processor for causing the processor to perform operations comprising:

receiving, from sensors in a wellbore, data corresponding to a plurality of loss indicators;

determining a plurality of loss probabilities, each loss probability of the plurality of loss probabilities corresponding to a loss indicator of the plurality of loss indicators;

determining, based on the plurality of loss probabilities, a total loss probability of fluid loss in the wellbore;

determining, based on the total loss probability of fluid loss in the wellbore, a loss mitigation operation; and controlling the loss mitigation operation in the wellbore.

16. The non-transitory computer-readable medium of claim 15, further comprising instructions that are executable by the processor for causing the processor to:

determine, using an artificial intelligence model of the wellbore, an expected loss in the wellbore;

determine a difference between the total loss probability and the expected loss;

determine, based on the difference between the total loss and the expected loss, a loss origin;

determine, based on the loss origin, the loss mitigation operation; and output the loss mitigation operation to be implemented in the wellbore.

17. The non-transitory computer-readable medium of claim 16, wherein the loss origin comprises a matrix loss, a natural fracture loss, an induced fracture loss, and a cavernous formation loss.

18. The non-transitory computer-readable medium of claim 15, further comprising instructions that are executable by the processor for causing the processor to determine the total loss probability by:

determining a plurality of weights, each weight of the plurality of weights corresponding to a loss probability of the plurality of loss probabilities; and weighting, by the plurality of weights, the plurality of loss probabilities to determine the total loss probability.

19. The non-transitory computer-readable medium of claim 18, further comprising instructions that are executable by the processor for causing the processor to continuously adjust the plurality of weights based on newly received data corresponding to the plurality of loss indicators.

20. The non-transitory computer-readable medium of claim 15, wherein the plurality of loss indicators comprises a flow gain indicator, a tank volume indicator, and a formation pressure indicator.

* * * * *